US007641079B2

(12) United States Patent
Lott et al.

(10) Patent No.: US 7,641,079 B2
(45) Date of Patent: Jan. 5, 2010

(54) AEROSOL CAN VALVE AND COVER ASSEMBLY

(75) Inventors: Joseph C. Lott, Des Peres, MO (US); Kenneth J. Rueschhoff, Wildwood, MO (US); Richard A. Berger, Troy, MO (US)

(73) Assignee: Clayton Corporation, Fenton, MO (US)

( * ) Notice: Subject to any disclaimer, the term of this patent is extended or adjusted under 35 U.S.C. 154(b) by 393 days.

(21) Appl. No.: 11/714,078

(22) Filed: Mar. 5, 2007

(65) Prior Publication Data

US 2007/0290006 A1 Dec. 20, 2007

Related U.S. Application Data

(60) Provisional application No. 60/778,831, filed on Mar. 3, 2006.

(51) Int. Cl.
*B65D 83/20* (2006.01)

(52) U.S. Cl. ..... 222/402.13; 222/402.15; 222/153.07

(58) Field of Classification Search ..... 222/153.05, 222/153.11, 402.11, 402.13, 402.15, 402.21, 222/402.22, 153.07
See application file for complete search history.

(56) References Cited

U.S. PATENT DOCUMENTS

| | | | | |
|---|---|---|---|---|
| 3,848,778 | A | 11/1974 | Meshberg | |
| 4,739,901 | A | 4/1988 | Dorfman et al. | |
| 4,826,054 | A * | 5/1989 | Frutin | 222/402.11 |
| 4,844,250 | A * | 7/1989 | Holoubek et al. | 222/107 |
| 5,040,705 | A * | 8/1991 | Snell | 222/402.15 |
| 6,032,830 | A | 3/2000 | Brown | |
| 6,340,103 | B1 * | 1/2002 | Scheindel et al. | 222/402.15 |
| 6,685,064 | B2 | 2/2004 | Frutin | 222/402.15 |
| 6,820,777 | B2 | 11/2004 | Frutin | 222/402.15 |
| 2003/0071085 | A1 * | 4/2003 | Lasserre et al. | 222/521 |
| 2003/0075571 | A1 * | 4/2003 | Thompson et al. | 222/402.15 |
| 2004/0238572 | A1 | 12/2004 | Blake | |
| 2004/0256418 | A1 * | 12/2004 | Scheindel | 222/402.15 |
| 2005/0178802 | A1 | 8/2005 | Groh et al. | |

OTHER PUBLICATIONS

International Search Report and Written Opinion, Dated: Nov. 2, 2007, pp. 11.

* cited by examiner

*Primary Examiner*—Kevin P Shaver
*Assistant Examiner*—Daniel R Shearer
(74) *Attorney, Agent, or Firm*—Harness, Dickey & Pierce, P.L.C.

(57) ABSTRACT

A cover and trigger assembly is provided that includes having a valve that can be actuated for dispensing the contents of the can through an outlet of the valve. The assembly includes an annular component having a helical surface is secured to the can, and a cover coupled to the annular component. The cover has an opening through which a trigger extends, and the cover is rotatable relative to the helical surface on the annular component for rotatably raising or lowering the cover relative to the annular component. The raising or lowering of the cover respectively prohibits or permits movement of the trigger member to actuate the valve, thereby controlling dispensing operation of the valve.

23 Claims, 7 Drawing Sheets

AEROSOL CAN VALVE AND COVER ASSEMBLY

FIELD OF THE INVENTION

This invention relates to valves for aerosol cans, and in particular to an improved aerosol valve with a trigger dispensing control feature.

BACKGROUND OF THE INVENTION

Aerosol containers that dispense liquid or foam products are often packaged in aerosol cans with a pressurizing agent, which acts as a propellant for dispensing the product. These aerosol cans include a dispensing valve that may be operated to dispense the contents of the aerosol container as needed. A problem with these aerosol container products is that the dispensing valve may not effectively prevent inadvertent dispensing operation prior to delivery to the end user, or when the container is stored after intermittent use. Furthermore, these valves typically comprise numerous parts made from various materials that can make the valves difficult and expensive to assemble.

SUMMARY OF THE INVENTION

The present invention relates to a cover assembly for a valve for dispensing the contents of a pressurized aerosol can, such as a foam, liquid or food product. In one embodiment, a cover and trigger assembly is provided that includes having a valve that can be actuated for dispensing the contents of the can through an outlet of the valve. The assembly includes an annular component having a helical surface is secured to the can, and a cover coupled to the annular component. The cover has an opening through which a trigger extends, and the cover is rotatable relative to the helical surface on the annular component for rotatably raising or lowering the cover relative to the annular component. The raising or lowering of the cover respectively prohibits or permits movement of the trigger member to actuate the valve, thereby controlling dispensing operation of the valve.

In another aspect of the present invention, some embodiments of a cover assembly are provided that include a detachable portion that resists rotation of the cover to a position in which the movement of the trigger will actuate the valve, to prohibit dispensing operation of the valve.

In another aspect of the present invention, one embodiment of a cover and trigger assembly is provided that includes a trigger pivotally coupled to a rotatable cover positioned over a valve of an aerosol can. The cover assembly includes an annular component having an outer helical surface that is secured to the aerosol can, and a conduit coupled to the outlet of the valve. A cover having an opening therein has a trigger member pivotally coupled to the cover. The trigger member has an aperture and a handle portion that extends through the opening in the cover. The cover is received over the annular component in a manner such that a portion of the conduit extends through the aperture in the trigger member and through the opening in the cover. The cover is movable relative to the helical surface on the annular component for rotatably raising the cover to a first position in which the pivotal movement of the trigger does not actuate the valve, and for rotatably lowering the cover to at least a second position in which the pivotal movement of the trigger causes the actuation of the valve to permit dispensing operation of the valve. A detachable portion of the annular component is received in a slot in the cover, such that the detachable portion resists rotation of the cover from the first position in which the trigger member does not actuate the valve.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

Corresponding reference numerals indicate corresponding parts throughout the several views of the drawings.

DETAILED DESCRIPTION OF THE EMBODIMENTS

The following description of the embodiments is merely exemplary in nature and is in no way intended to limit the invention, its application, or uses.

Figure 1:
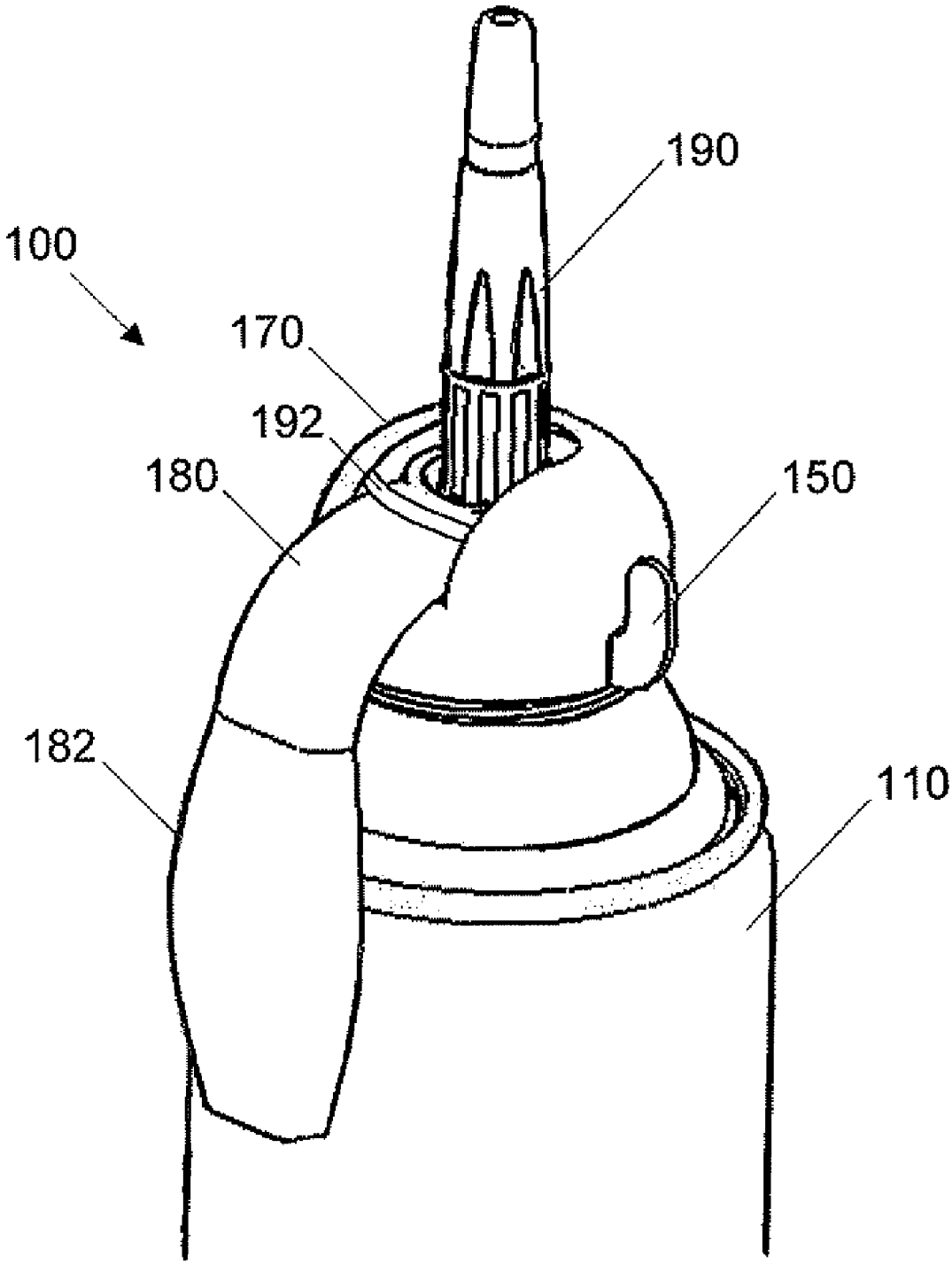
FIG. 1 is a perspective view of one embodiment of a cover assembly for a valve in accordance with the principles of the present invention.

One embodiment of cover and trigger assembly for an aerosol can or container constructed according to the principles of this invention is indicated generally as 100 in FIG. 1. The cover assembly 100 generally comprises a cover member 170, a trigger member 180 having a handle portion 182, and a nozzle portion 190 in communication with the outlet of a dispensing valve on the aerosol can 110. The cover assembly 100 is configured to be secured onto an aerosol can 110 having a dispensing valve thereon (not shown in FIG. 1), which valve may be actuated to permit dispensing operation of the contents of the aerosol can or container 110 The cover assembly may optionally comprise a detachable portion 150 that resists movement or rotation of the cover 170 to a position which permits dispensing operation of the valve, as will be explained in more detail below. Some embodiments of a cover assembly may also comprise a tamper evident frangible portion 192 spanning an opening of the cover 170, which resists lifting of the trigger 180 or movement of the cover 170 to a dispensing position.

Figure 2:
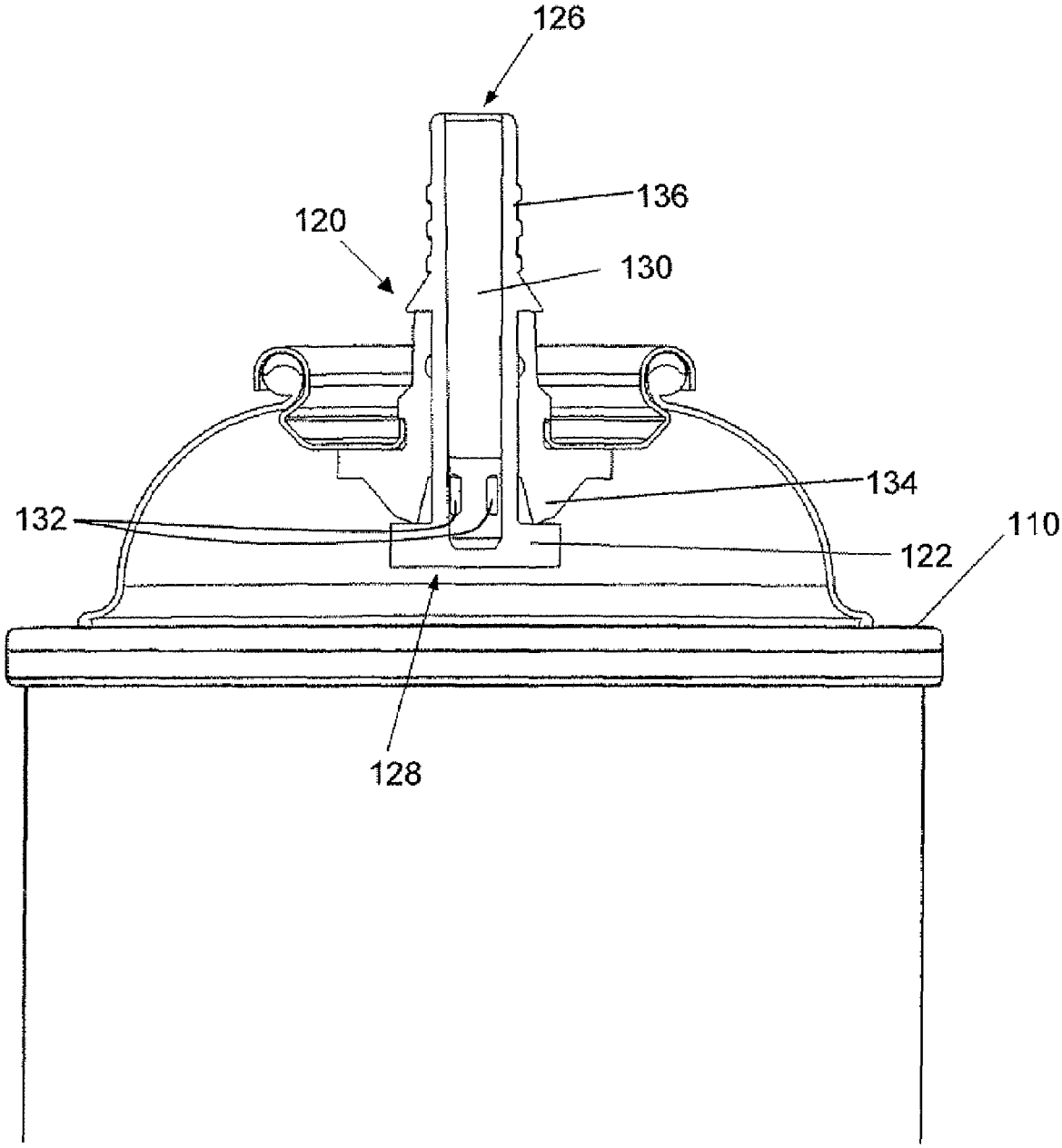
FIG. 2 is a section view of one embodiment of a dispensing valve that dispenses contents of an aerosol can when a valve stem is displaced.

Referring to FIG. 2, the aerosol can 110 has a dispensing valve 120 secured within an opening in an aerosol can 110. The dispensing valve 120 generally comprises a valve seat 134 having a movable valve member 122 having a central passage 130 leading to an outlet 126. Displacing the movable valve member 122 permits dispensing operation through the dispensing valve to the outlet 126. More specifically, the dispensing valve may comprise a valve seat 134 having a central opening. A movable valve member 122 is disposed within the opening of the valve seat 134, and has a sealing surface for sealing against the valve seat's tapered end. One or more openings 132 extend through the valve member 122 and communicate with the central passage 130. When the valve stem 136 is displaced, it opens a space between the seal of the valve member 122 and the valve seat 134, so that the pressurized contents can exit the container between the valve member 122 and the seat 134, through the openings 132, and out the passage 130 to the exit 126. Accordingly, the valve assembly 120 secured to the aerosol can 110 is operable to permit dispensing operation through an outlet 126 of the valve 120.

Figure 3:
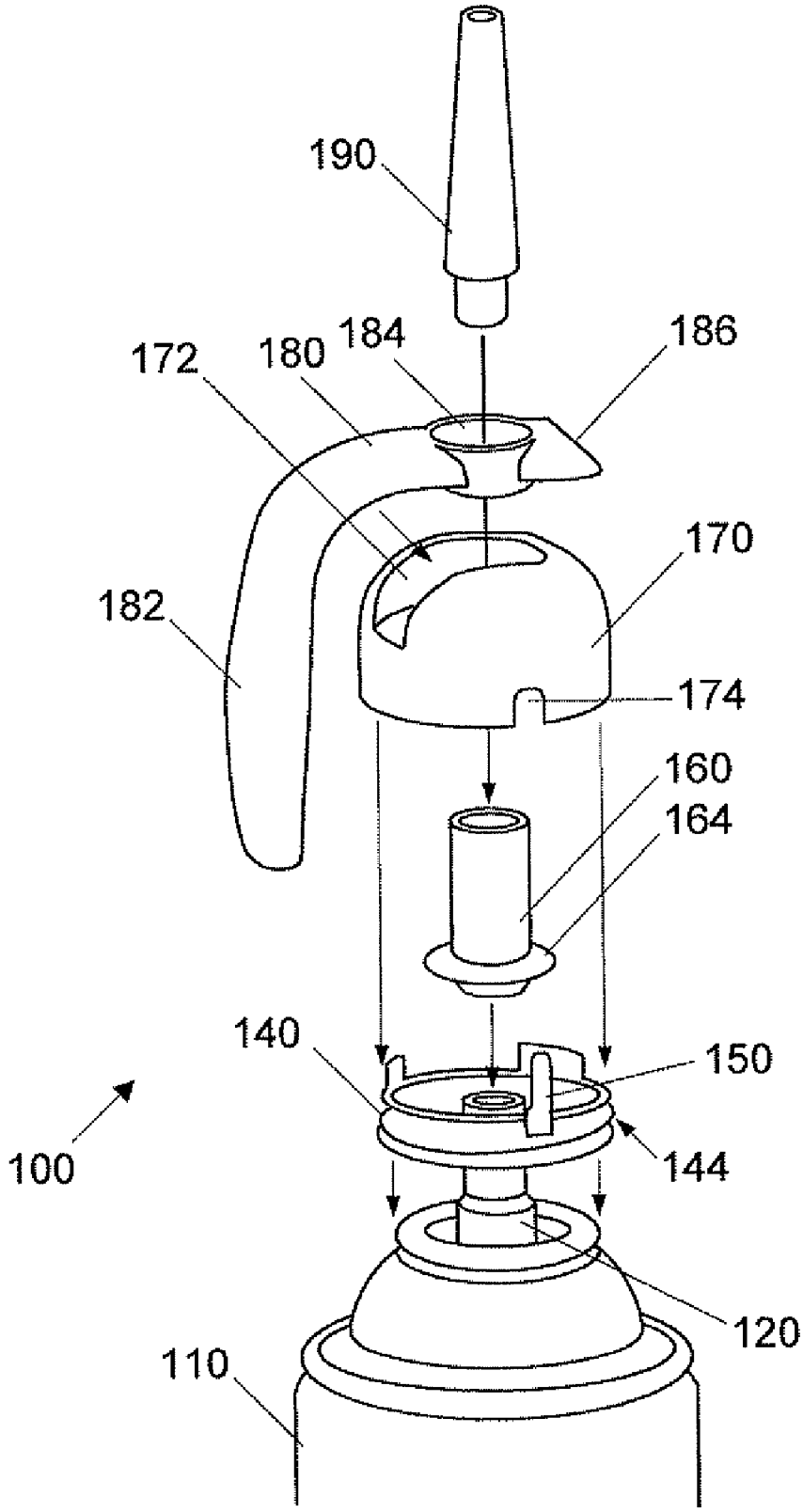
FIG. 3 is an exploded assembly view of the cover assembly shown in FIG. 1.

Referring to FIG. 3, the cover and trigger assembly 100 for an aerosol can 110 further comprises an annular ring or component 140 secured to the aerosol can 110. The annular component 140 has a helical surface 144 disposed along the outer surface of the annular component 140, which is generally cam-shaped or ramped in nature. The annular component 140 preferably comprises a configuration that permits the annular component to be secured to and retained over a lip or ring on the top of an aerosol can or container. The annular component 140 further comprises a detachable portion 150 that restricts movement of a cover 170 to a position in which dispensing operation is enabled. The annular component 140 may further comprise one or more projections that further limit the range of movement of the cover relative to the annular component, which will be explained in more detail below.

Figure 4:
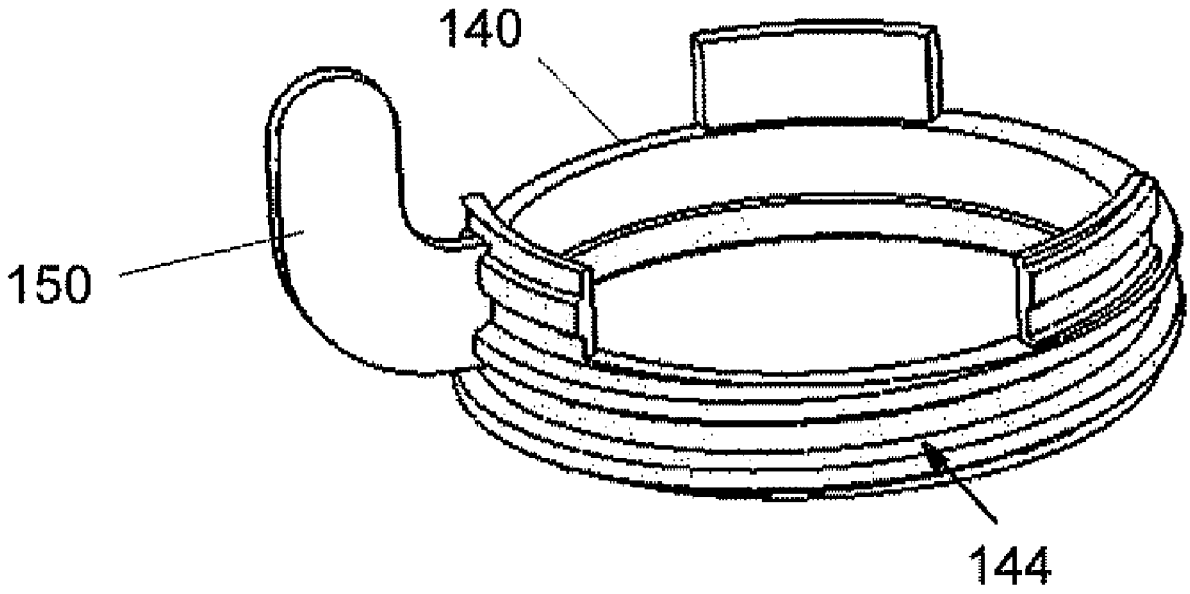
FIG. 4 is a perspective view of an annular component for a cover assembly.
Figure 5:
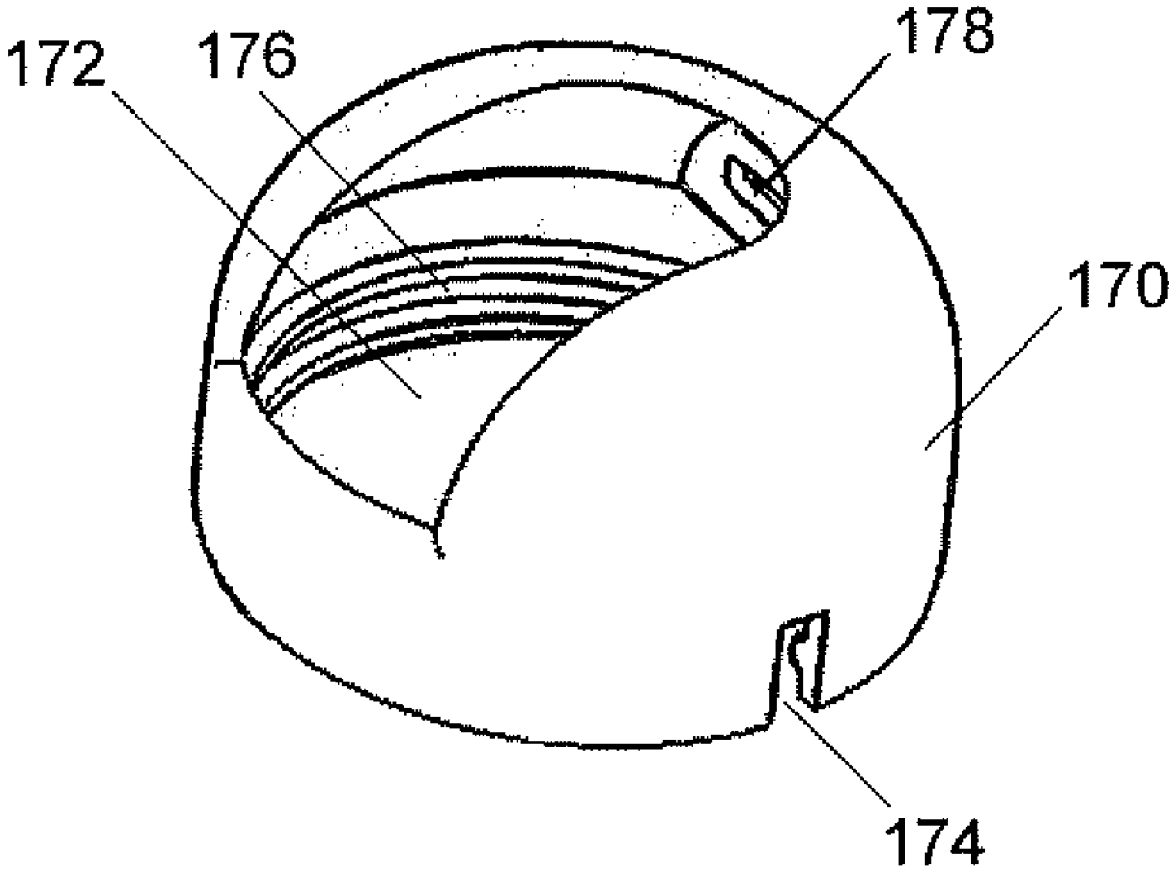
FIG. 5 is a perspective view of a cover for a cover assembly.
Figure 6:
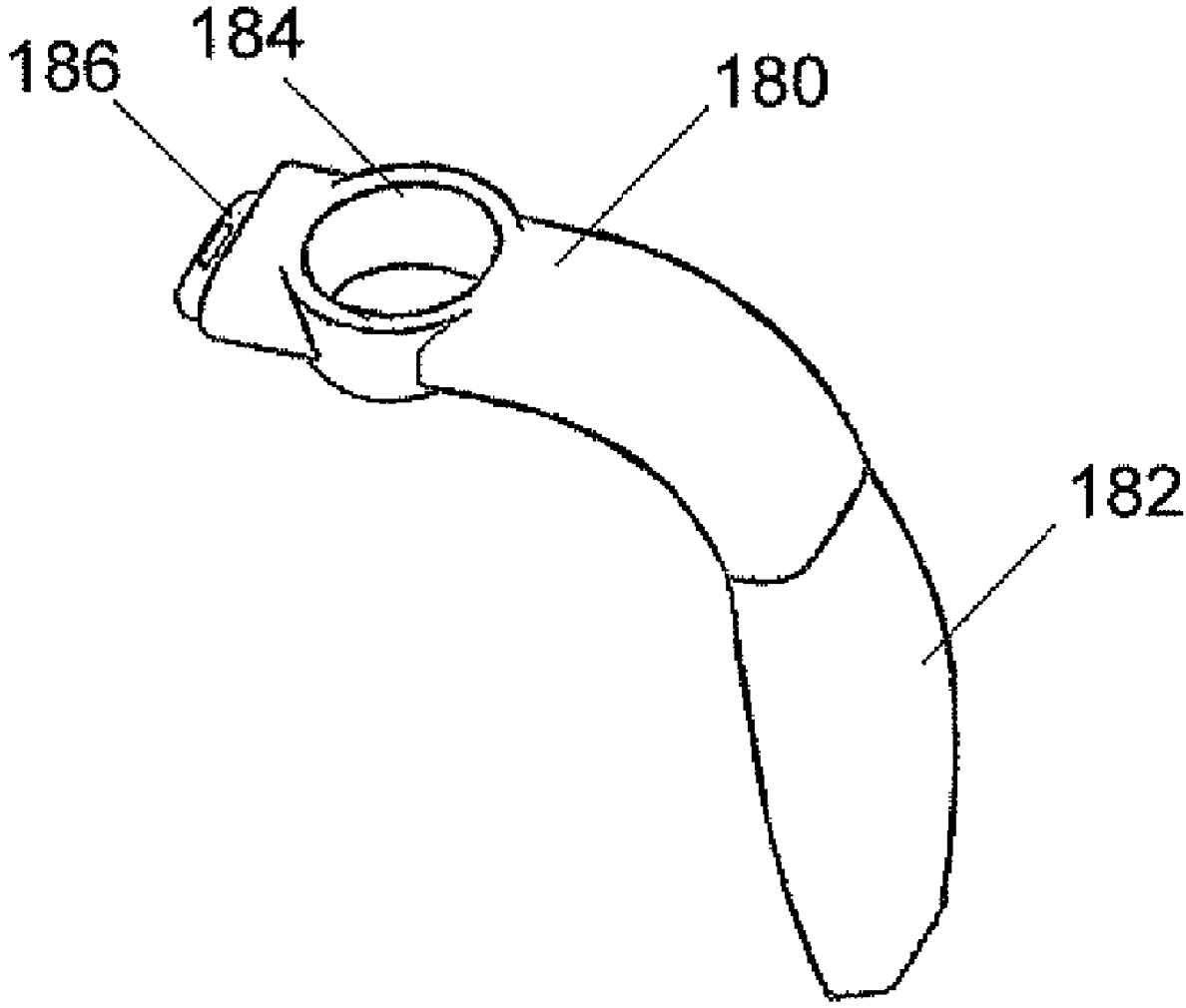
FIG. 6 is a perspective view of a trigger member for a cover assembly.

The cover and trigger assembly 100 further includes a trigger member 180 having a handle portion 182 and also an aperture 184 extending through the trigger member 180. The trigger member 180 is configured to be received within an opening 172 in the cover member 170. The cover member 170 has an opening 172 that extends along a portion of the top and side of the cover 170, through which the handle portion 182 extends. Referring to FIGS. 5 and 6, an end 186 on the trigger member 180 is configured to be received within the cover 170 at cavity 178, for pivotally coupling the trigger 180 to the cover 170. The cover member 170 is coupled to the annular component 140, and is rotatable relative to the helical surface 144 on the annular component 140. As shown in FIG. 4, the helical surface 144 on the annular component 140 preferably comprises an external thread around the outer surface of the annular component 140. Likewise, the cover 180 shown in FIG. 5 comprises a mating surface 176 that is received against the helical surface 144 of the annular component 140. The mating surface 176 on the inner portion of the cover 170 preferably comprises an internal thread around an inner portion of the cover 170. It should be noted that the helical surface 142 and mating component 176 may comprise other cam-shaped or ramped surface designs as an alternative to the external threads of the annular component. The cover member 170 may rotate relative to the helical surface 144 for rotatably raising or lowering the cover member 140 relative to the annular component 140 to respectively prohibit or permit movement of the trigger member 180 to operate the valve assembly 120, thereby controlling dispensing operation of the valve 120. The cover member 170 may further comprise a slot 174 in the side of the cover, in which the detachable portion 150 extending outwardly from the annular component 140 is received. When the detachable portion 150 of the annular component 140 is received within the slot 174 in the cover member 170, the trigger member 180 is restricted from operating the valve assembly 120 to prevent dispensing operation. Specifically, the detachable portion 150 of the annular component 140 is received within the slot 174 so as to resist rotation of the cover member 170 relative to the annular component 140 from a position in which movement of the trigger member 180 is prohibited from effectuating dispensing operation of the valve assembly 120. Initially, the cover member 170 is in a first elevated position relative to the annular component 140, in which first position the movement of the trigger member 180 does not engage or cause to actuate the valve assembly, such that dispensing operation of the valve is prohibited. Accordingly, the detachable portion 150 restricts rotation of the cover 170 and downward movement of the cover 170 and trigger member 180 towards a position in which valve actuation and dispensing operation is permitted, to provide a tamper resistant means for inhibiting dispensing operation of the valve prior to sale or use of the aerosol product by the intended user.

When the detachable portion 150 is removed from the annular component 140, the cover member 170 is rotatable relative to the annular component 140 to at least one position that permits movement of the trigger member 180 that will engage or cause the valve 120 to be actuated, to effect dispensing operation of the valve assembly 120. Thus, once the detachable portion 150 is removed from the annular component 140, the cover member 170 is rotatable relative to the annular component 140 to a first storable position in which movement of the trigger member 180 is prevented from effectuating dispensing operation of the valve assembly 120, and is rotatable relative to the annular component 140 to at least a second open position in which movement of the trigger member 180 effects dispensing operation of the valve assembly 120. Dispensing operation may be established by pressing the handle portion 182 to pivot the trigger member 180 to cause the valve to be actuated. Upon release of the handle portion, the valve 120 returns to a closed position by a biasing force provided by a valve conduit 124 that the valve stem portion is disposed in.

The cover assembly 100 may further comprise a conduit 160 coupled to the outlet 126 of the valve assembly 120, wherein the aperture 184 in the trigger member 180 is received over a portion of the conduit 160. The cover assembly 100 may further comprise a nozzle tip 190 releasably connected to the conduit 160, such that actuation of the valve 120 permits dispensing operation through the valve outlet 126, the conduit 160 and the nozzle tip 190. It should be noted that the nozzle tip may comprise any number of shapes and orientations, and may project in directions other than in line with the can. The aperture 184 permits the trigger member 180 to rotate about the conduit 160, such that the trigger member 180 coupled to the cover 170 may be rotated about the conduit 160 concurrent to rotation of the trigger member 180 about the annular component 140. The cover member 170 rotates relative to the helical surface 144 on the annular component 140, which helical surface 144 may comprise external threads on the annular component 140. Rotation of the cover 170 relative to the external threads causes the cover member 170 to be raised or lowered relative to the annular component 140.

Figure 7:
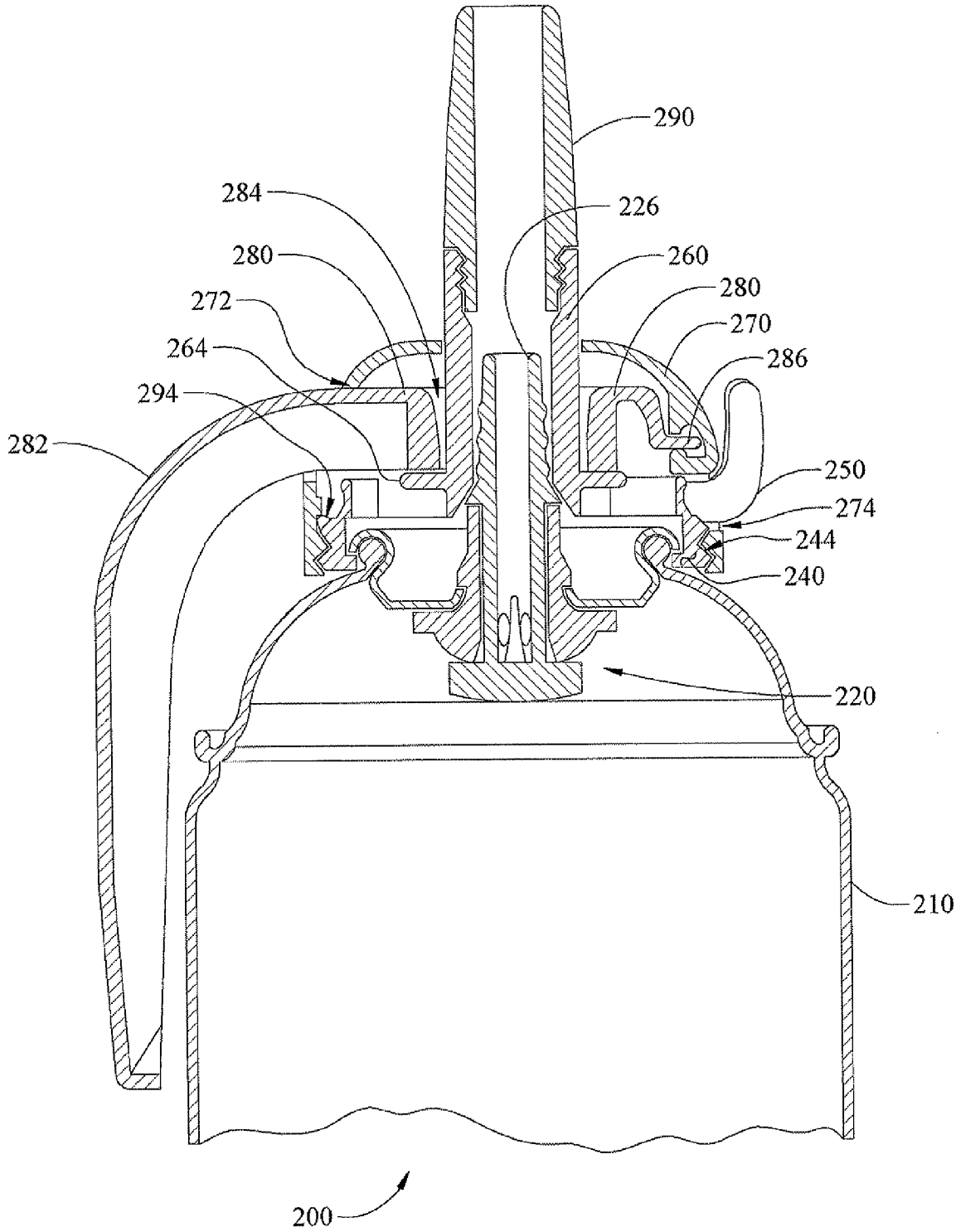
FIG. 7 is a cross-section view of a second embodiment of a dispensing valve and trigger assembly.

Referring to FIG. 7, a second embodiment of a cover and trigger assembly 200 for an aerosol can 210 having a valve 220 that can be actuated is shown. The cover assembly 200 comprises an annular component 240 secured to the aerosol can 210 much like the first embodiment. The annular component 240 has an outer helical surface, and a conduit 260 is coupled to the outlet of the valve 226. The annular component 240 may also include a detachable portion 250 extending from the component. A cover 270 is provided that has an opening 272 therein, and a trigger member 280 is pivotally coupled to the cover 270. The trigger member 280 has an aperture 284 therein and a handle portion 282 that extends through the opening 272 in the cover 270. The cover 280 is received over the annular component 240 in a manner such that a portion of the conduit 260 extends through the aperture 284 in the trigger member 280 and through the opening 272 in the cover 270. An end 286 on the trigger member 280 is pivotally coupled to the cover 270. The cover 270 is movable relative to the helical surface 244 on the annular component 240 for rotatably raising the cover 270 to a first position in which the pivotal movement of the trigger member 280 does not actuate the valve, and for rotatably lowering the cover 270 to at least a second position in which the pivotal movement of the trigger member 280 causes the actuation of the valve to permit dispensing operation of the valve. The detachable portion 250 extending outwardly from the annular component 240 is received within a slot 274 in the cover 270 when the cover 270 is received over the annular component 240, such that the detachable portion 250 resists rotation of the cover 270 from the first position in which pivotal movement of the trigger member 280 is prohibited from or does not actuate the valve. Accordingly, the detachable portion 250 restricts rotation of the cover 270 and downward movement of the cover 270 and trigger member 280 towards a position in which valve actuation and dispensing operation is permitted, to provide a tamper resistant means for inhibiting dispensing operation of the valve prior to sale or use of the aerosol product by the intended user.

In the second embodiment, when the detachable portion 250 is removed from the annular component 240, the cover 270 is permitted to rotate relative to the annular component 240 to at least a second position in which the pivotal movement of the trigger member 280 causes the actuation of the valve to permit dispensing operation of the valve. Dispensing operation may be established by pressing the handle portion 282 to pivot the trigger member 280 to cause the valve to be actuated. Upon release of the handle portion, the valve 220 returns to a closed position by a biasing force provided by the valve.

When the cover 280 is rotated relative to the annular component 240 from the first closed position to at least one dispensing position, the trigger member 280 in such dispensing position is moveable to engage the conduit 260 for causing the valve to be actuated to permit dispensing operation of the valve. The handle portion 282 of the trigger member 280 may be depressed to pivotally move the trigger member 280 to its fullest extent, which displaces the conduit by an amount that is determined by the rotational position of the cover 270. The cover 270 may be rotated to various positions that vary in height relative to the annular component. The trigger member 280 may accordingly be raised or lowered relative to the conduit or valve, to incrementally or infinitely vary the extent to which the trigger member 280 engages the conduit. This in turn varies the extend to which the valve is actuated, to control the flow or dispensing rate through the valve. Thus, variably rotating the cover 180 to one or more dispensing positions can adjust the extent of engagement and therefore control the actuation of the valve to vary the dispensing operation.

In the second embodiment, the trigger member 280 engages a shoulder 264 on the conduit 260 that is received over the valve outlet 226, where the engagement causes the valve to be actuated. Alternatively, the aperture 284 in the trigger member 280 may be sized such that the aperture of the trigger member 280 engages the cylindrical portion of the conduit 260 when the cover 270 is in the lowered dispensing position. It should be apparent that the above disclosed embodiment is merely exemplary, and modifications that may be contemplated in engaging the conduit or causing the valve to be actuated. Accordingly, is not intended that the invention be limited by the particular embodiments or forms disclosed herein, but by the appended claims.

The cover and trigger assembly 200 may further comprise a nozzle tip 290 releasably connected to the conduit 260, which tip may be removed and replaced to permit cleaning or replacement with a new nozzle tip. The annular component 240 may further comprise one or more detents 294 therein, corresponding to one or more rotational positions of the cover 270. By rotating the cover 270 to each of the one or more detent positions, the extent of trigger actuation and valve dispensing operation may be selectably varied.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A cover assembly for an aerosol can comprising:

a valve assembly secured to the aerosol can, the valve assembly having a valve stem that when displaced is operable to permit dispensing operation through an outlet of the valve;

an annular component secured to the aerosol can, the annular component having a helical surface;

a cover member having an opening therein and a trigger member pivotally coupled to the cover, the trigger member having a handle portion that extends through the opening in the cover, and an aperture therein through which a portion of the valve stem extends, the cover member being coupled to the annular component and being rotatable relative to the helical surface on the annular component, wherein the cover is movable relative to the helical surface on the annular component for rotatably raising the cover to a first position in which the pivotal movement of the trigger does not cause displacement of the valve stem and actuation of the valve, and for rotatably lowering the cover to at least a second position in which the pivotal movement of the trigger causes the displacement of the valve stem and actuation of the valve, to respectively prohibit or permit movement of the trigger member to displace the valve stem that operates the valve assembly, thereby controlling dispensing operation of the valve.

2. The cover assembly of claim 1, wherein the annular component further comprises a detachable portion extending outwardly from the annular component.

3. The cover assembly of claim 2, wherein when the detachable portion of the annular component is received within a slot in the cover member, the trigger member is restricted from operating the valve assembly to prevent dispensing operation.

4. The cover assembly of claim 2, wherein the detachable portion of the annular component is received within a slot in the cover member so as to resist rotation of the cover member relative to the annular component from a position in which movement of the trigger member is prohibited from effectuating dispensing operation of the valve assembly.

5. The cover assembly of claim 4, wherein when the detachable portion is removed from the annular component, the cover member is rotatable relative to the annular component to at least one position that permits movement of the trigger member to effect dispensing operation of the valve assembly.

6. The cover assembly of claim 1 further comprising a conduit coupled to the outlet of the valve assembly, wherein the aperture in the trigger member is received over a portion of the conduit.

7. A cover assembly for an aerosol can comprising:

a valve assembly secured to the aerosol can, the valve assembly being operable to permit dispensing operation through an outlet of the valve;

an annular component secured to the aerosol can, the annular component having a helical surface;

a trigger member having an aperture therein and a handle portion thereon; a cover member having an opening through which the handle portion extends, the cover member being coupled to the annular component and being rotatable relative to the helical surface on the annular component, for rotatably raising or lowering the cover member relative to the annular component to respectively prohibit or permit movement of the trigger member to operate the valve assembly, thereby controlling dispensing operation of the valve;

a conduit coupled to the outlet of the valve assembly, wherein the aperture in the trigger member is received over a portion of the conduit, and a nozzle tip releasably connected to the conduit.

8. A cover assembly for an aerosol can comprising:

a valve assembly secured to the aerosol can, the valve assembly being operable to permit dispensing operation through an outlet of the valve;

an annular component secured to the aerosol can, the annular component having a helical surface;

a trigger member having an aperture therein and a handle portion thereon; a cover member having an opening through which the handle portion extends, the cover member being coupled to the annular component and being rotatable relative to the helical surface on the annular component, for rotatably raising or lowering the cover member relative to the annular component to respectively prohibit or permit movement of the trigger member to operate the valve assembly, thereby controlling dispensing operation of the valve; and a conduit coupled to the outlet of the valve assembly, wherein the aperture in the trigger member is received over a portion of the conduit, wherein the trigger member is rotatable about the conduit and pivotally movable within the opening in the cover member, such that the trigger member may be rotated about the conduit concurrent to rotation of the cover member about the annular component.

9. A cover assembly for an aerosol can comprising:

a valve assembly secured to the aerosol can, the valve assembly being operable to permit dispensing operation through an outlet of the valve;

an annular component secured to the aerosol can, the annular component having a helical surface;

a trigger member having an aperture therein and a handle portion thereon; a cover member having an opening through which the handle portion extends, the cover member being coupled to the annular component and being rotatable relative to the helical surface on the annular component, for rotatably raising or lowering the cover member relative to the annular component to respectively prohibit or permit movement of the trigger member to operate the valve assembly, thereby controlling dispensing operation of the valve; and a conduit coupled to the outlet of the valve assembly, wherein the aperture in the trigger member is received over a portion of the conduit, wherein the helical surface comprises an external thread on the annular component that causes the cover member to be raised or lowered relative to the annular component when the cover member is rotated about the external thread.

10. A cover assembly for an aerosol can having a valve that can be actuated for dispensing the contents of the can through an outlet of the valve, the cover assembly comprising:

an annular component secured to the aerosol can, the annular component having an outer helical surface;

a conduit coupled to the outlet of the valve;

a cover having an opening therein and a trigger member pivotally coupled to the cover, the trigger member having an aperture therein and a handle portion that extends through the opening in the cover, the cover being received over the annular component in a manner such that a portion of the conduit extends through the aperture in the trigger member and through the opening in the cover; and wherein the cover is movable relative to the helical surface on the annular component for rotatably raising the cover to a first position in which the pivotal movement of the trigger does not actuate the valve, and for rotatably lowering the cover to at least a second position in which the pivotal movement of the trigger causes the actuation of the valve to permit dispensing operation of the valve.

11. The cover assembly of claim 10, further comprising a detachable portion on the annular component that is received within a slot in the cover when the cover is received over the annular component, such that the detachable portion resists rotation of the cover from the first position in which pivotal movement of the trigger member does not actuate the valve.

12. The cover assembly of claim 11, wherein when the detachable portion is removed from the annular component, the cover is permitted to rotate relative to the annular component to at least a second position in which the pivotal movement of the trigger causes the actuation of the valve to permit dispensing operation of the valve.

13. The cover assembly of claim 12 further comprising a nozzle tip releasably connected to the conduit.

14. The cover assembly of claim 12, wherein the annular component comprises one or more detents corresponding to one or more rotational positions of the cover member, for varying the extent of valve actuation and dispensing operation of the valve.

15. The cover assembly of claim 10, further comprising a frangible portion spanning across at least a portion of the opening in the cover, which when the cover is rotated to at least a second position in which the pivotal movement of the trigger causes the actuation of the valve to permit dispensing operation of the valve, the trigger member causes the frangible portion to break for providing a tamper evident indication.

16. A cover and trigger assembly for an aerosol can having a valve that can be actuated for dispensing the contents of the can through an outlet of the valve, the cover assembly comprising:

an annular component secured to the aerosol can, the annular component having a detachable portion and an outer helical surface;

a conduit coupled to the outlet of the valve;

a cover having an opening therein and a trigger member pivotally coupled to the cover, the trigger member having an aperture therein and a handle portion that extends through the opening in the cover, the cover being received over the annular component in a manner such that a portion of the conduit extends through the aperture in the trigger member and through the opening in the cover; and wherein the cover is movable relative to the helical surface on the annular component for rotatably raising the cover to a first position in which the pivotal movement of the trigger does not actuate the valve, and for rotatably lowering the cover to at least a second position in which the pivotal movement of the trigger causes the actuation of the valve to permit dispensing operation of the valve; and wherein the detachable portion of the annular component is received in a slot in the cover such that the detachable portion resists rotation of the cover from the first position in which pivotal movement of the trigger member does not actuate the valve.

17. The cover and trigger assembly of claim 16, wherein when the detachable portion is removed from the annular component, the cover member is rotatable relative to the annular component to at least a second position in which the pivotal movement of the trigger causes the actuation of the valve to permit dispensing operation of the valve.

18. The cover and trigger assembly of claim 17 wherein when the cover is rotated relative to the annular component to at least one position that is lower than the first closed position, the movement of the trigger member engages the conduit for causing the valve to be actuated to permit dispensing operation of the valve.

19. The cover and trigger assembly of claim 18 wherein the trigger member engages a shoulder on the conduit for causing the valve to be actuated.

20. The cover and trigger assembly of claim 19 further comprising a nozzle tip releasably connected to the conduit.

21. The cover and trigger assembly of claim 18 wherein the helical surface on the annular component comprises external threads on the annular component, and the cover is threadably received onto the threads of the annular component.

22. The cover and trigger assembly according to claim 17 wherein the cover may be rotated to one or more dispensing positions that vary the extent to which the trigger member may engage the conduit, for varying the actuation of the valve to adjust the level of dispensing operation of the valve.

23. The cover and trigger assembly according to claim 22, wherein the annular component comprises one or more detents corresponding to one or more rotational positions of the cover member, for selectively varying the extent of valve actuation and level of dispensing operation of the valve.

* * * * *